US009599124B2

(12) United States Patent
Roberge et al.

(10) Patent No.: US 9,599,124 B2
(45) Date of Patent: Mar. 21, 2017

(54) AIR DIFFUSER FOR VACUUM FAN OF PLANTERS

(71) Applicant: CNH Industrial Canada, Ltd., Saskatoon (CA)

(72) Inventors: Martin Roberge, Saskatoon (CA); Michael Boyko, Saskatoon (CA); Brian J. Anderson, Yorkville, IL (US)

(73) Assignee: CNH Industrial Canada, Ltd., Saskatoon, Saskatchewan (CA)

( * ) Notice: Subject to any disclaimer, the term of this patent is extended or adjusted under 35 U.S.C. 154(b) by 392 days.

(21) Appl. No.: 14/243,689

(22) Filed: Apr. 2, 2014

(65) Prior Publication Data

US 2015/0285269 A1 Oct. 8, 2015

(51) Int. Cl.

| | |
|---|---|
| ***F04D 29/44*** | (2006.01) |
| ***F04D 17/16*** | (2006.01) |
| ***F04D 29/42*** | (2006.01) |
| ***F04D 29/66*** | (2006.01) |

(52) U.S. Cl.

CPC ..... *F04D 29/441* (2013.01); *F04D 17/168* (2013.01); *F04D 29/4226* (2013.01); *F04D 29/664* (2013.01); *F04D 29/665* (2013.01); *F05D 2250/52* (2013.01)

(58) Field of Classification Search

CPC .. F04D 29/441; F04D 29/665; F04D 29/4226; F04D 17/168; F04D 29/664; F05D 2250/52

USPC ..... 415/119, 120, 200, 206

See application file for complete search history.

(56) References Cited

U.S. PATENT DOCUMENTS

| | | | | | |
|---|---|---|---|---|---|
| 2,726,807 | A | * | 12/1955 | Lewis | A47L 7/0009 15/320 |
| 3,196,977 | A | | 7/1965 | Sanders | |
| 3,794,137 | A | | 2/1974 | Teodorescu et al. | |
| 4,050,913 | A | | 9/1977 | Roach | |
| 4,076,099 | A | | 2/1978 | Proksch | |
| 4,177,629 | A | | 12/1979 | Kennedy | |
| 4,236,597 | A | | 12/1980 | Kiss et al. | |
| 4,281,740 | A | | 8/1981 | Weiss et al. | |
| 4,325,459 | A | | 4/1982 | Martin | |
| 4,669,952 | A | * | 6/1987 | Forsyth, III | F04D 29/444 415/119 |
| 4,718,924 | A | | 1/1988 | DeMarco | |
| 4,786,299 | A | | 11/1988 | DeMarco | |
| 4,810,269 | A | | 3/1989 | Stackhouse et al. | |
| 5,127,238 | A | * | 7/1992 | Ichikawa | B60H 1/3204 415/53.1 |

(Continued)

OTHER PUBLICATIONS

Reference notes retrieved from Google.corn, "Farm Machinery and Power", Power et al. dated Dec. 31, 2007 (1 page).

*Primary Examiner* — Hoang Nguyen
(74) *Attorney, Agent, or Firm* — Rebecca L. Henkel; Rickard K. DeMille

(57) ABSTRACT

A diffuser for the vacuum fan used with agricultural equipment. The diffuser has a rectangular outlet fixed to the outlet of the fan and a diverging rectangular cross-section outlet for increasing the cross-sectional flow area. A primary flow path between the inlet and the outlet is no less in area than the inlet to the diffuser and a series of rectangular side chambers with perforated walls covered by sound deadening material have predetermined dimensions to decrease the outlet air velocity attenuate selected noise frequencies.

15 Claims, 2 Drawing Sheets

(56) References Cited

U.S. PATENT DOCUMENTS

| | | | | |
|---|---|---|---|---|
| 6,722,594 | B2 | 4/2004 | Graham | |
| 6,729,557 | B2 | 5/2004 | Dillon | |
| 8,511,426 | B2 | 8/2013 | Colam | |
| 2002/0079159 | A1* | 6/2002 | Liu | F04D 29/4213 181/210 |
| 2003/0161717 | A1* | 8/2003 | Liu | F04D 29/665 415/1 |
| 2013/0115052 | A1* | 5/2013 | Lee | F04D 29/444 415/119 |

* cited by examiner

AIR DIFFUSER FOR VACUUM FAN OF PLANTERS

BACKGROUND OF THE INVENTION

1. Field of the Invention

The present invention relates to vacuum fans used in the agricultural field, and, more particularly, to diffusers for such fans.

2. Description of the Related Art

The vacuum fan has a key roll in the apparatus used for planting seeds in a field. Among other possible functions, it is used to create a vacuum within a series of seed metering devices to pull seeds onto a metering disk so that they may be accurately and consistently delivered through the planter mechanism to the soil. The fan for this purpose typically has a high flow rate owing to the number of planter components. In the arrangement of the planter, the fan is placed behind the operator of a tractor used to pull or support the planting apparatus. The inlet or suction side of the fan is connected to the seed metering mechanisms but the outlet of typical vacuum fans is directed upward. The rotational speeds in the 3,000 to 5,000 RPM range necessary to produce the volume flow cause higher levels of noise in various frequencies. These can cause operator discomfort. Furthermore, the unaltered exhaust flow from the vacuum fan has a high velocity which creates turbulence and can effect the dust normally generated around the planting apparatus. This becomes essentially a greater problem if the outlet of the vacuum fan is pointed in a direction other than vertical when it is necessary to diffuse the exhaust air over the ground.

Accordingly, what is needed in the art is a vacuum fan exhaust that has velocity reducing and sound attenuating properties.

SUMMARY OF THE INVENTION

The invention seeks to reduce both noise levels and outlet velocity for agricultural vacuum fans.

In one form, the invention is a diffuser for the outlet of vacuum fan. The diffuser includes a housing having an inlet connected to the outlet of the vacuum fan, an outlet having diverging walls to increase the cross-sectional flow area and a flow path between the inlet and outlet that is no less than the cross-sectional flow area of the inlet. The housing has a primary flow path between the inlet and the outlet and side chambers extending from the primary flow path, the side chambers having predetermined dimensions for attenuating specific noise frequencies.

In another form, the invention is a vacuum fan having a housing with a centrifugal impeller positioned within the housing, a motor for driving the impeller, an inlet adjacent the center of rotation for the impeller and an outlet directed generally tangentially. A diffuser for the outlet includes a housing having an inlet connected to the outlet of the vacuum fan, an outlet having diverging walls to increase the cross-sectional flow area and a flow path between the inlet and outlet that is no less than the cross-sectional flow area of the inlet. The housing has a primary flow path between the inlet and outlet with side chambers extending from the primary flow path, with each side chambers having predetermined dimensions for attenuating specific noise frequencies.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention and such exemplification is not to be construed as limiting the scope of the invention in any manner.

DETAILED DESCRIPTION OF THE INVENTION

Figure 1:
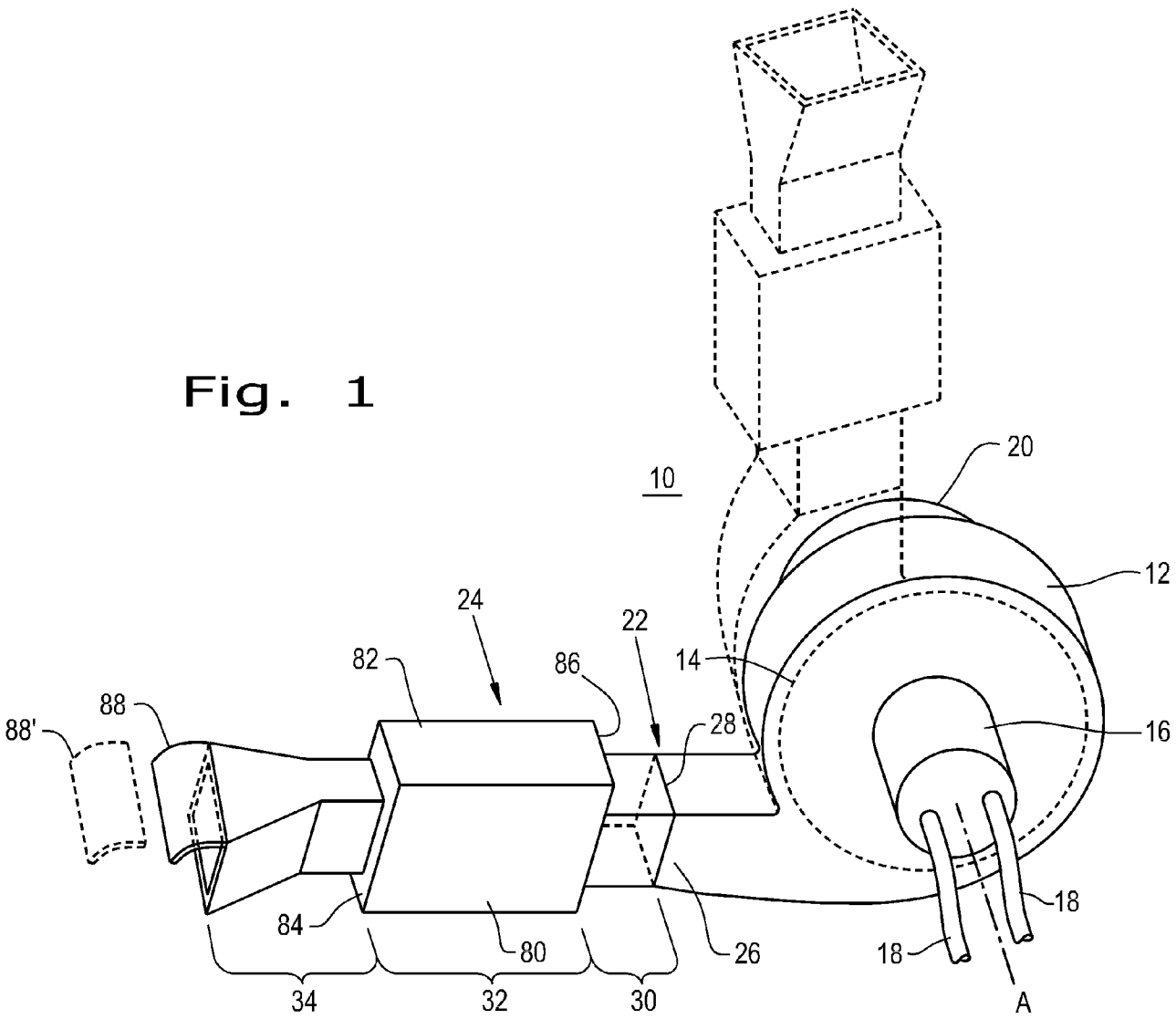
FIG. 1 is a perspective view of a vacuum fan used in the agricultural field along with an outlet diffuser embodying the present invention.

Referring now to the drawings, and more particularly to FIG. 1, there is shown a vacuum blower 10 used for agricultural purposes. Vacuum blower 10 is typically utilized in a planter for the metering operation to insure that seeds are uniformly planted into the soil. The details of the planter apparatus beyond the blower are not included to enable a clearer understanding of the present invention. The vacuum blower 10 has an annular outer housing 12 in which a centrifugal impeller 14 is journaled and driven by motor 16 about an axis A. The impeller 14 may take any one of a number of forms which allows air to be directed radially outward. The motor 16 may be one of a number of types of power units but is herein shown as a hydraulic motor with appropriate pressure and return lines 18. The motor 16 drives impeller 12 to accelerate air towards an outlet and draws an air through inlet 20 which reduces pressure and is therefore called a vacuum blower. The inlet 20 would typically be connected apply a vacuum to various components within the planter to provide the metering function.

The accelerated air is directed tangentially (relative to axis A) through outlet 22 through a diffuser 24 into the atmosphere. As illustrated in FIG. 1, the outlet 22 is rectangular and has side walls 28 and 26 to discharge air substantially horizontally relative to the soil. Alternatively, the discharge may be vertical as shown by the dashed lines. In accordance with the present invention, the diffuser 24 is incorporated with the vacuum blower 10 to significantly reduce noise emanation and to reduce air stream velocity from the unit to minimize the problem of dust lift.

Referring now to FIGS. 2-5, the diffuser 24 has an inlet section 30, main section 32 and outlet section 34 in the form of a diverging cross sectional flow area. Inlet section 30 has sidewalls 36 and 38 which are extensions of and are connected to the side walls 26 and 28 of blower outlet 22. Main section 32 has end walls 42 and 40 and walls 44 and 46 making a rectangular housing forming an extension of inlet section 30. Walls 44 and 46 are joined by walls 48 and 50 to complete the rectangular housing. Outlet section 34 includes diverging opposed walls 52 and 54 which are interconnected by walls 56 to form a rectangular but diverging cross sectional flow area.

Figure 3:
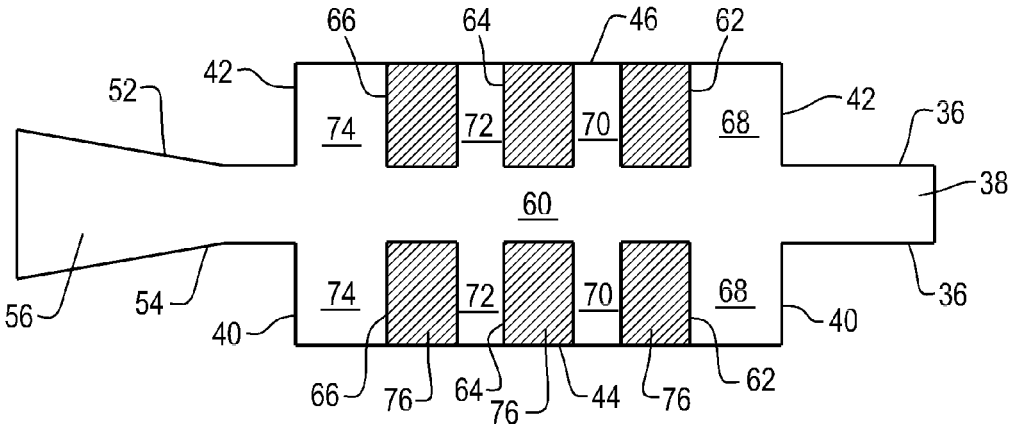
FIG. 3 is a cross-sectional view of FIG. 1 taken on lines 3-3 of FIG. 2.

As is particularly evident from FIG. 3, the various structures form a primary flow path 60 leading from inlet section 30 to outlet section 34 which has a cross-sectional flow area no less than the cross-sectional flow area of inlet section 30. Within the section 32 there are positioned rectangular U-shaped wall sections 62, 64 and 66 extending inward from walls 44 and 46 to form a plurality of side chambers 68, 70, 72 and 74 extending from primary flow path 60 in between the U-shaped wall sections. The chambers 68, 70, 72 and 74 are preselected so that particular frequencies of noise may be attenuated.

Figure 2:
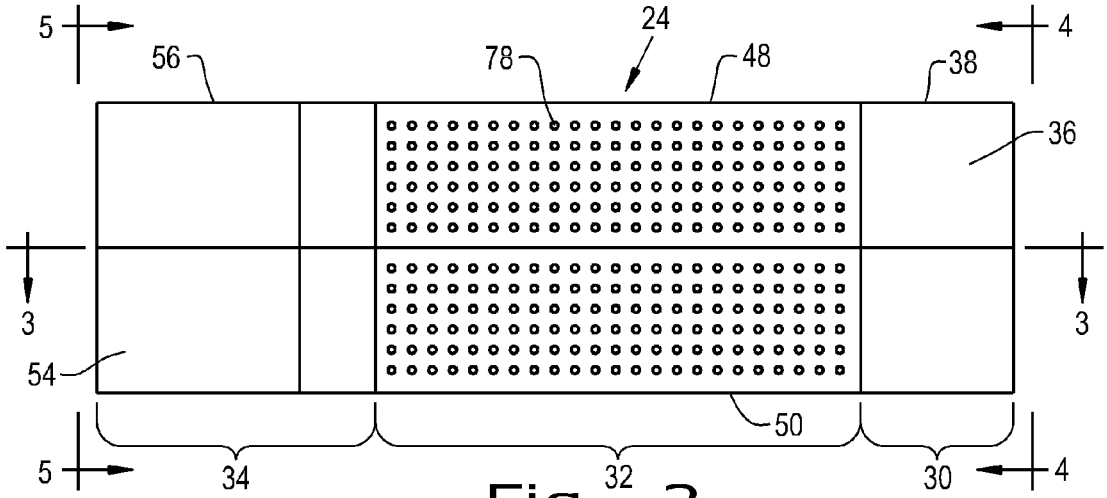
FIG. 2 is a side view of the diffuser of FIG. 1.
Figure 5:
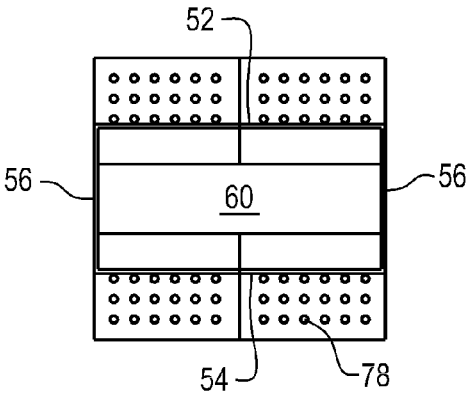
FIG. 5 is an end view of the diffuser of FIG. 2 taken on lines 5-5 of FIG. 2.
Figure 4:
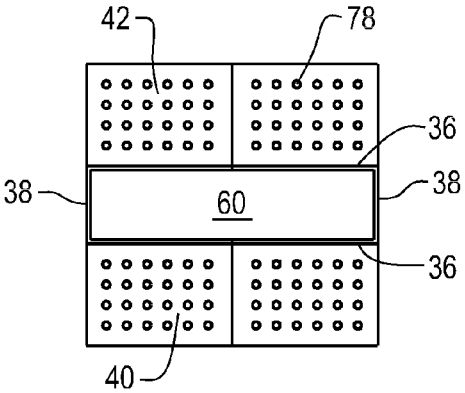
FIG. 4 is an end view of the diffuser of FIG. 2 taken on lines 4-4 of FIG. 2.

As particularly illustrated in FIGS. 2, 4 and 5, walls 44 and 46 and 42 and 40 are perforated with perforations 78. The interior space of U-shaped walls 62, 64 and 66 are filled with sound deadening material 76 which typically may be fiberglass insulation. As shown in FIG. 1, the exterior walls of center section 32 are covered by walls 80, 82, 84 and 86 of sound absorbing material.

In operation, the vacuum blower 10 operates to accelerate air and discharge it through outlet 22 into diffuser 24. Diffuser 24 has a primary flow path 60 that is not less than the cross-sectional flow area of inlet section 30 so that there is no restriction to air flow. Primary flow path passes 60 extends to the outlet 34 which has a divergent section integral with the diffuser 24 to decelerate the air flow and therefore minimize dust lift. The chambers 68, 70, 72 and 74 are selected to attenuate particular noise frequencies to minimize the apparent noise by an operator pulling the vacuum blower in an agricultural implement. The perforations in the walls 46, 44 and 42 allow noise frequencies to escape and to be trapped within the sound absorbing material 80 to 86. The overall effect of the diffuser 24 is to provide a simplified, robust component that minimizes noise levels as well as decrease the outflow velocity of the air to minimize dust lift. This is particularly important when the orientation of the outlet 22 of vacuum blower 10 is in the horizontal direction as shown in FIG. 1, as well as the vertical direction shown by the dashed lines. A deflector 88 is provided at outlet 34 as shown in solid lines or spaced from but in line with the outlet as shown by dashed lines by reference number 88.

Volume of the chambers 68, 70, 72 and 74 may be selected analytically or empirically to provide a maximum noise reduction. The diffuser provides a significant reduction in the velocity of the exhaust flow as well as sound attenuation.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A diffuser for the outlet of a vacuum fan, said diffuser comprising:

a housing having an inlet connected to the outlet of said vacuum fan, an outlet having diverging walls to increase the cross-sectional flow area, a flow path between said inlet and outlet that is no less than the cross-sectional flow area of said inlet, and a main section between the inlet and the outlet, the main section including first and second generally parallel side walls;

a first pair of spaced walls projecting from the first side wall of the housing and terminating at a location spaced from the second side wall, the first pair of walls defining a first side chamber communicating with the flow path through the housing;

a second pair of spaced walls projecting from the second side wall of the housing and terminating at a location spaced from the first side wall, the second pair of walls defining a second side chamber communicating with the flow path through the housing;

wherein the first and second side chambers have predetermined dimensions for attenuating specific noise frequencies.

2. The diffuser as claimed in claim 1, wherein the fan has rectangular outlet and said diffuser inlet has a rectangular inlet and the first and second side chambers are rectangular chambers.

3. The diffuser as claimed in claim 2, wherein the main section of the housing between the inlet and outlet of the housing of said diffuser has a rectangular cross-section.

4. The diffuser as claimed in claim 3, wherein the first and second side walls of the main section of the housing has perforations in communication with corresponding first and second side chambers.

5. The diffuser as claimed in claim 4, further comprising sound deadening panels positioned over the perforations in the first and second side walls of the main section of said housing.

6. The diffuser as claimed in claim 1, wherein the first and second pairs of walls are filled with sound deadening material.

7. The diffuser as claimed in claim 1, wherein the main section of the housing has an exterior and wherein sound deadening material is provided on the exterior of the main section of said housing.

8. The diffuser as claimed in claim 1, further comprising a deflector positioned at least at the outlet of said diffuser.

9. A vacuum fan comprising:

an annular housing;

a centrifugal impeller positioned for rotation within said housing, said housing having an inlet adjacent the rotational axis of said impeller and a tangential outlet for air flow;

a motor connected to and driving said impeller; and a diffuser comprising a housing having an inlet connected to the outlet of the housing, an outlet having diverging walls to increase the cross-section flow area, a flow path between the inlet at said inlet and outlet that is no less than the cross-sectional flow area of said inlet, and a main section between the inlet and the outlet of the diffuser, the main section including first and second generally parallel side walls;

a first pair of spaced walls projecting from the first side wall of the housing of the diffuser and terminating at a location spaced from the second side wall, the first pair of walls defining a first side chamber communicating with the flow path through the housing of the diffuser;

a second pair of spaced walls projecting from the second side wall of the housing of the diffuser and terminating at a location spaced from the first side wall, the second pair of walls defining a second side chamber communicating with the flow path through the housing of the diffuser;

wherein the first and second side chambers have predetermined dimensions for attenuating specific noise frequencies.

10. The vacuum fan as claimed in claim 9, wherein the fan has a rectangular outlet and the diffuser has a rectangular inlet.

11. The vacuum fan as claimed in claim 10, wherein the main section of the housing of the diffuser between the inlet and outlet of the housing of said diffuser has a generally rectangular cross-section.

12. The vacuum fan as claimed in claim 11, wherein the first and second side walls of the housing of the diffuser has perforations in communication with corresponding first and second chambers.

13. The vacuum fan as claimed in claim 12, wherein the housing of the diffuser has an exterior and wherein the exterior of the housing has sound deadening panels thereon over the perforations in the first and second side walls of said housing of the diffuser.

14. The vacuum fan as claimed in claim 10, wherein the first and second pairs of walls are filled with sound deadening material.

15. The diffuser as claimed in claim 9, further comprising a deflector positioned at least at the outlet of said diffuser.

* * * * *